United States Patent [19]

Johnson

[11] Patent Number: 5,016,390

[45] Date of Patent: May 21, 1991

[54] SHUTTER ASSEMBLY

[76] Inventor: Daniel B. Johnson, 5838 Walnut Dr., Eureka, Calif. 95501

[21] Appl. No.: 432,208

[22] Filed: Nov. 6, 1989

[51] Int. Cl.[5] ..... E06B 7/02

[52] U.S. Cl. ..... 49/38

[58] Field of Search ..... 49/38, 39, 325, 356, 49/425; 98/41.3, 40.28; 137/625.33; 160/202, 222, 197

[56] References Cited

U.S. PATENT DOCUMENTS

| | | | |
|---|---|---|---|
| 14,798 | 5/1856 | Bruff . | |
| 264,275 | 9/1882 | Gee . | |
| 350,757 | 10/1886 | Maratta . | |
| 465,889 | 12/1891 | Riester . | |
| 671,756 | 4/1901 | Chase . | |
| 728,657 | 5/1903 | Beatty | 49/425 |
| 949,600 | 2/1910 | Rylander . | |
| 1,740,626 | 12/1929 | Petrelli | 49/38 |
| 1,860,648 | 5/1932 | Bokan . | |
| 2,527,740 | 10/1950 | Kurtzon | 49/425 |
| 4,033,073 | 7/1977 | Bogan | 49/38 |
| 4,254,584 | 3/1981 | Hess | 49/325 |
| 4,676,145 | 6/1987 | Allred | 49/38 X |

FOREIGN PATENT DOCUMENTS

| | | | |
|---|---|---|---|
| 1232839 | 1/1967 | Fed. Rep. of Germany | 49/325 |
| 568996 | 11/1957 | Italy . | |

*Primary Examiner*—Rodney M. Lindsey
*Assistant Examiner*—Jerry Redman
*Attorney, Agent, or Firm*—Baker, Maxham, Jester & Meador

[57] ABSTRACT

A shutter closure assembly for covering an opening in a building or the like comprises a stationary panel having a front face defined by a plurality of alternate vertical rails and slots, and a back face defined by a plurality of alternate horizontally extending rails and slots forming a substantially uniform array of openings throughout a major area thereof, and a moveable panel having a front face defined by a complementary plurality of horizontal rails formed by a plurality of horizontal slots, and a back face defined by a plurality of vertical rails formed by a plurality of vertical slots forming a corresponding array of openings and moveable relative to the stationary panel for alternately covering and uncovering the openings in the stationary panel.

6 Claims, 4 Drawing Sheets

FIG. 3
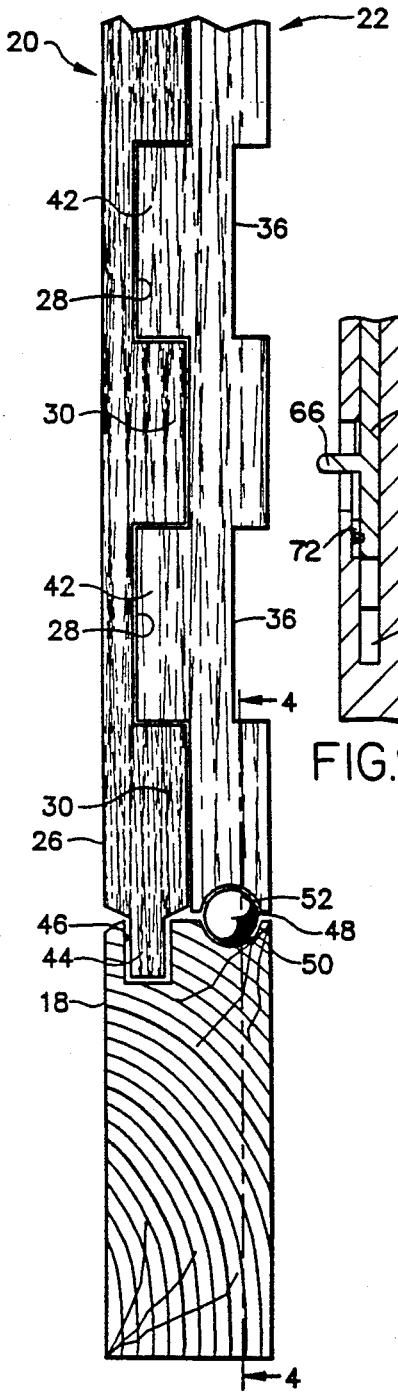
FIG. 4
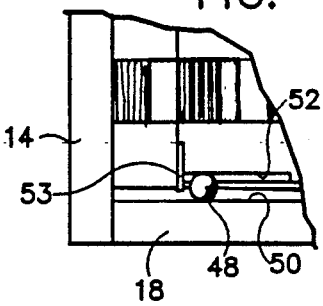
FIG. 5
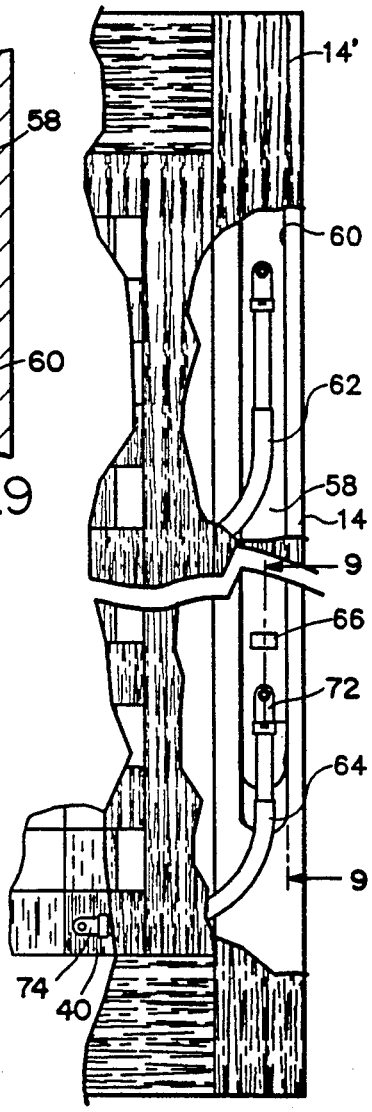
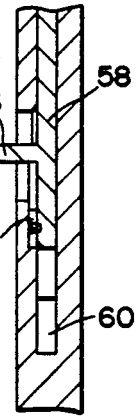
FIG.9
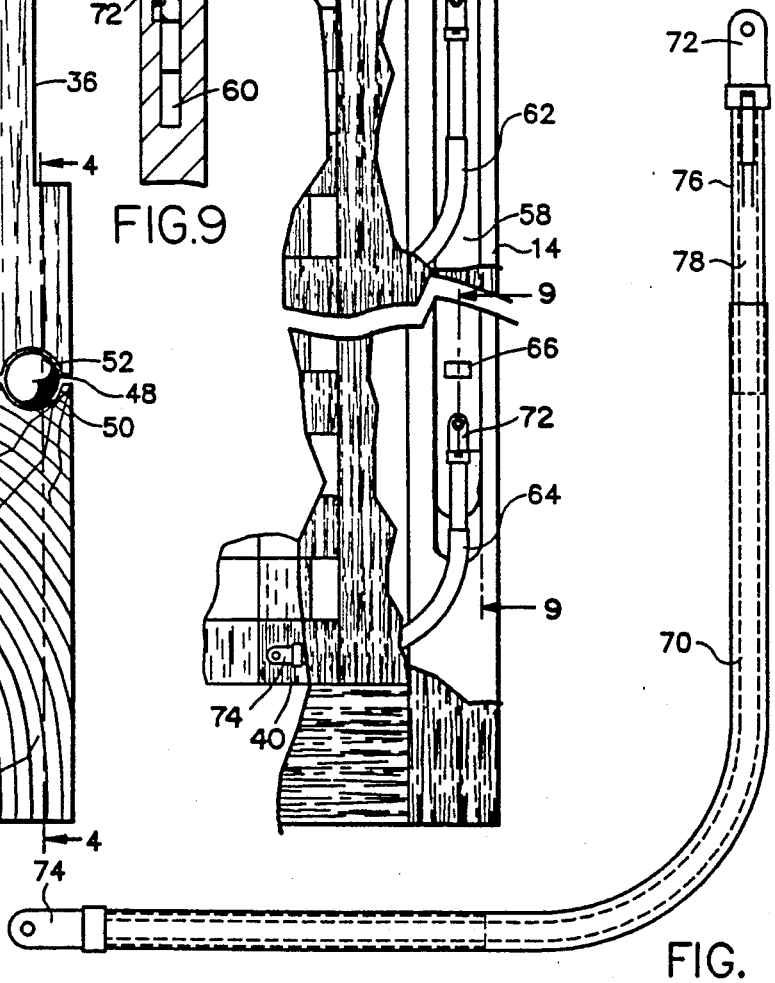
FIG. 6

FIG. 7
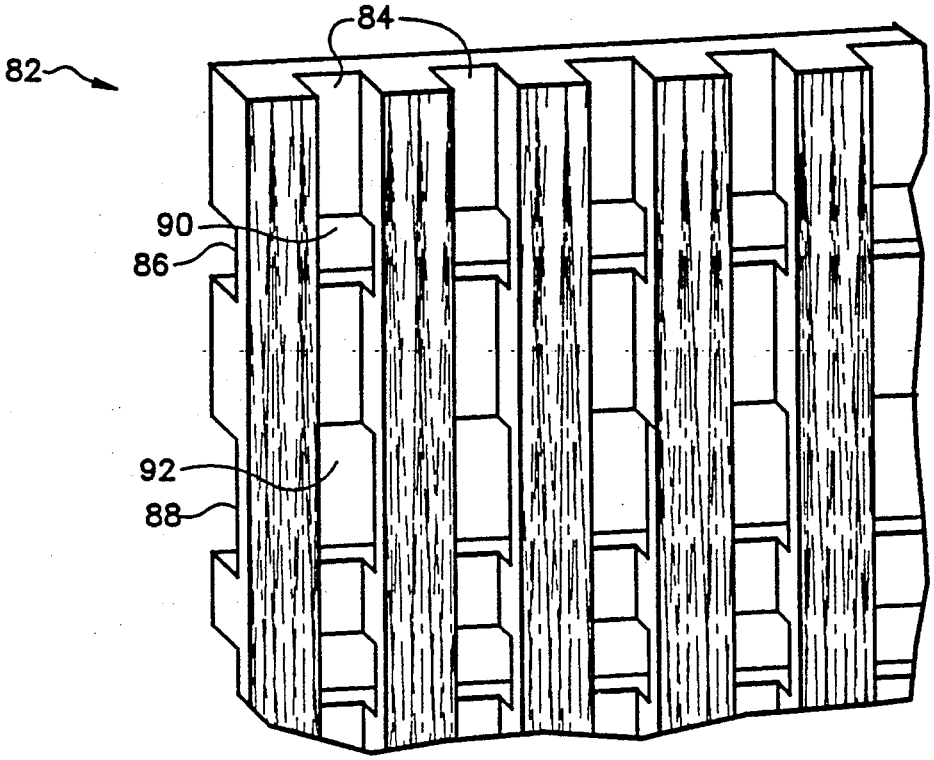
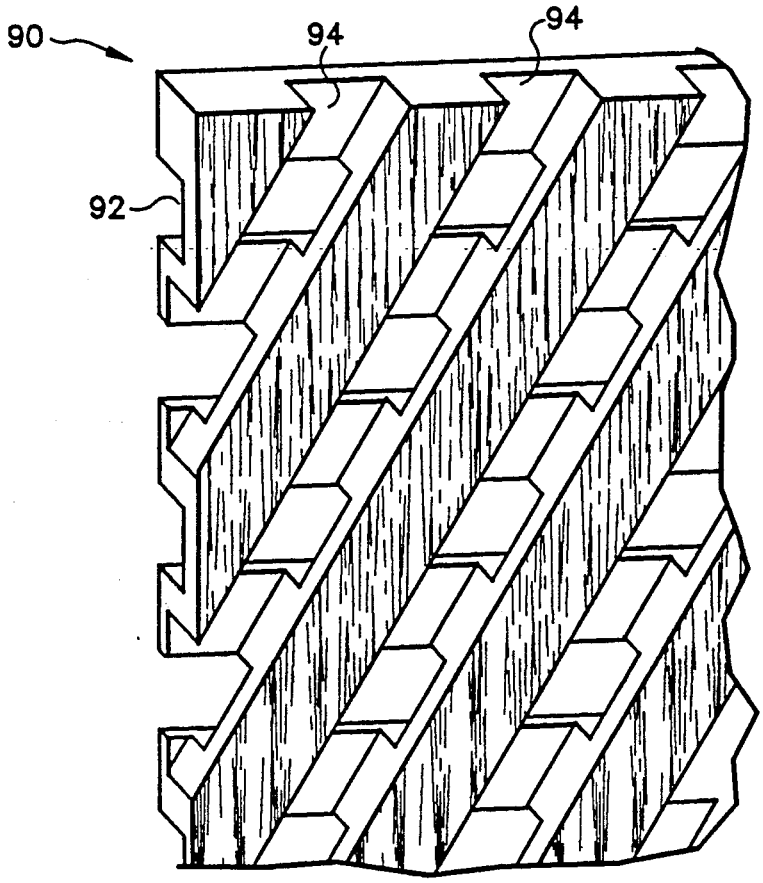
FIG. 8

SHUTTER ASSEMBLY

BACKGROUND OF THE INVENTION

The present invention relates to closures for window and door openings and pertains particularly to an improved shutter assembly.

Shutters of various types have been widely used for covering window openings in buildings for controlling the ingress of light and air through the window opening. Many forms of shutters are available, and each have their own advantages and disadvantages. One of the more popular types of shutters is the pivoting or hinged louvered type, wherein louvers are mounted for pivoting about a horizontal axis to control the degree of opening between the louvers.

Other pivoting louvers are available that pivot about a vertical axis. These louvered types generally have an advantage of ease of adjustment over a wide range. However, they have the disadvantages of being rather fragile and difficult to clean. They also require a large amount of space within which to pivot.

Another type of shutter is that of a sliding panel within a frame to alternately cover and uncover an opening. A typical example of this construction is disclosed in U.S. Pat. No. 4,033,073, issued July 5, 1977 to Bogan. This patent discloses a ladder like fixed panel mounted within a frame structure, with a vertically movable ladder like frame mounted within or to the first panel by a tongue and groove construction. The movable panel is movable vertically to provide various degrees of openings between the slots thereof and those of the fixed panel. Magnets are utilized to secure the movable panel in its closed vertical position. Among the major problems with this construction is that it is difficult to adjust to any position between full open and full closed. Moreover, the movable panel must be moved against its weight, and therefore must be supported by carefully selected magnets or some complex latch or other mechanism.

Another drawback to the aforementioned construction is that the tongue and groove movable panel requires unusually accurate and precise construction. Also, it is subject to jamming due to warping, unusual wear, dirt and debris, and other factors.

Another example of the sliding panel type of shutter is illustrated in U.S. Pat. No. 1,860,648, issued May 31, 1932 to Bokan. This patent discloses a door or window closure having sliding panels, alternate screens and glass panels for converting alternately from a storm door or structure into a screen door or structure. This patent discloses both vertically slideable panels and horizontally slideable panels. These suffer from similar drawbacks to those previously described.

It is, therefore, desirable that improved shutter assemblies be available.

SUMMARY AND OBJECTS OF THE INVENTION

It is the primary object of the present invention to provide an improved shutter assembly.

In accordance with a primary aspect of the present invention, a shutter assembly for a screen or an opening in a building comprises a stationary panel, defined by a plurality of cross rails and grooves forming a substantially uniform array of openings throughout a major area thereof, with a movable panel formed of a complementary plurality of cross rails and grooves forming a corresponding array of openings, and movable relative to the first panel for alternately covering and uncovering the openings in the first panel.

BRIEF DESCRIPTION OF THE DRAWING

The above and other objects and advantages of the present invention will become apparent from the following description when read in conjunction with the accompanying drawings wherein:

FIG. 3 is a side elevation view in section taken on lines 3—3 of FIG. 1;

FIG. 4 is a partial view in section taken on line 4—4 of FIG. 3;

FIG. 5 is a detailed partial view of an edge of the shutter with portions broken away to reveal details;

FIG. 6 illustrates a flexible actuator link;

FIG. 7 is a perspective view illustrating an alternate embodiment;

FIG. 8 is a perspective view illustrating a further embodiment; and

FIG. 9 is a section view taken on line 9—9 of FIG. 5.

DETAILED DESCRIPTION OF A PREFERRED EMBODIMENT

Figure 1:
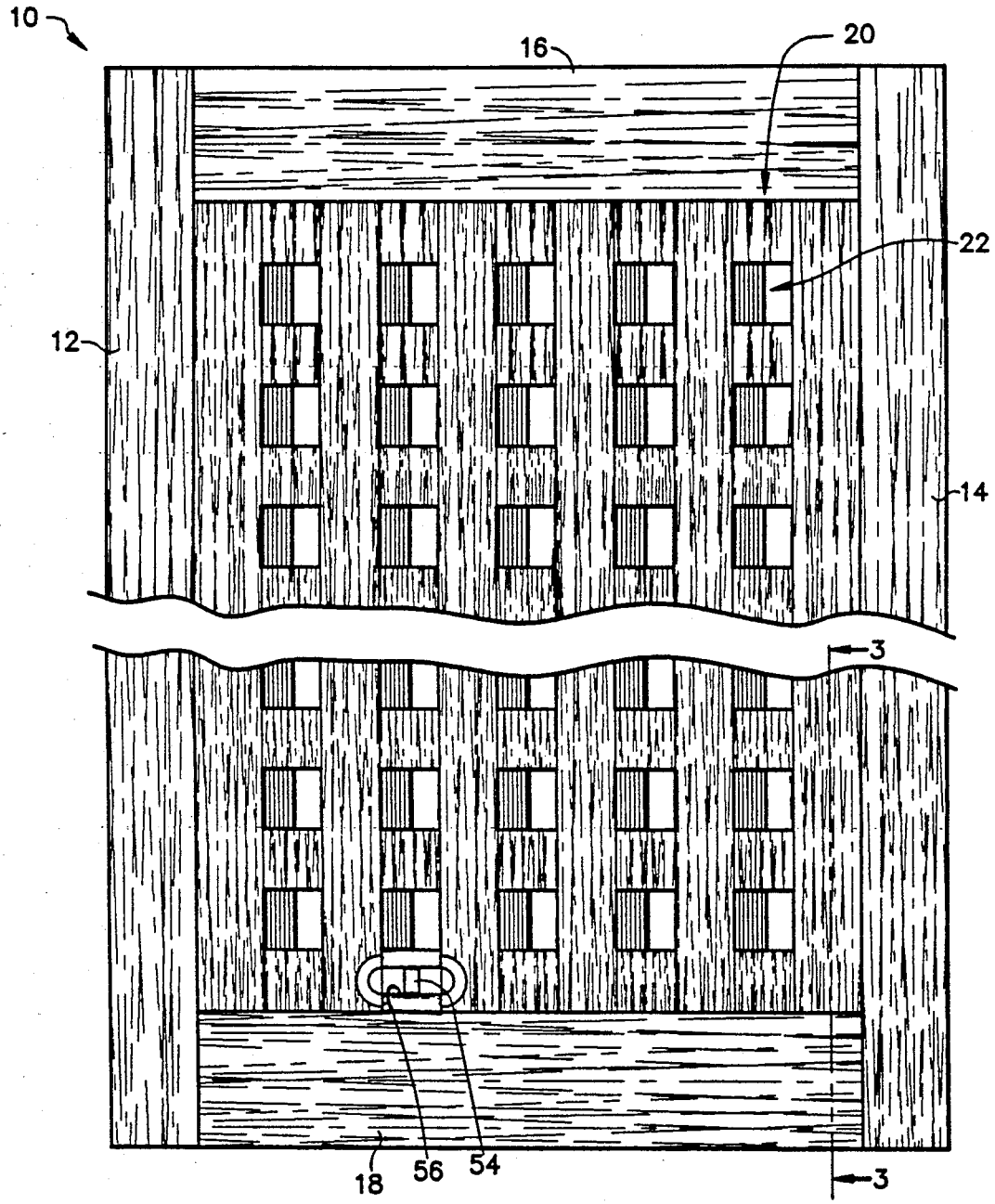
FIG. 1 is a front elevation view of a preferred embodiment of the invention.
Figure 2A:
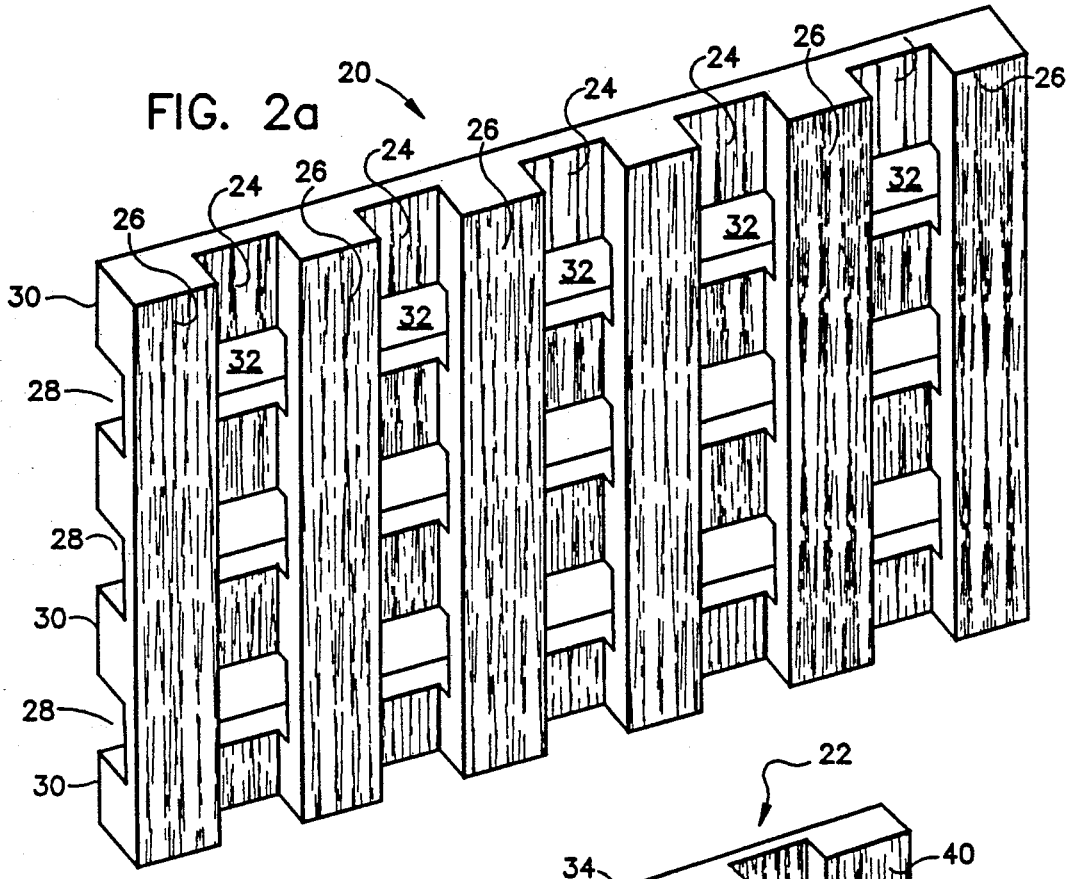
FIGS. 2*a* and 2*b* are perspective views showing details of the construction of the fixed panel and the movable panel, respectively.
Figure 2B:
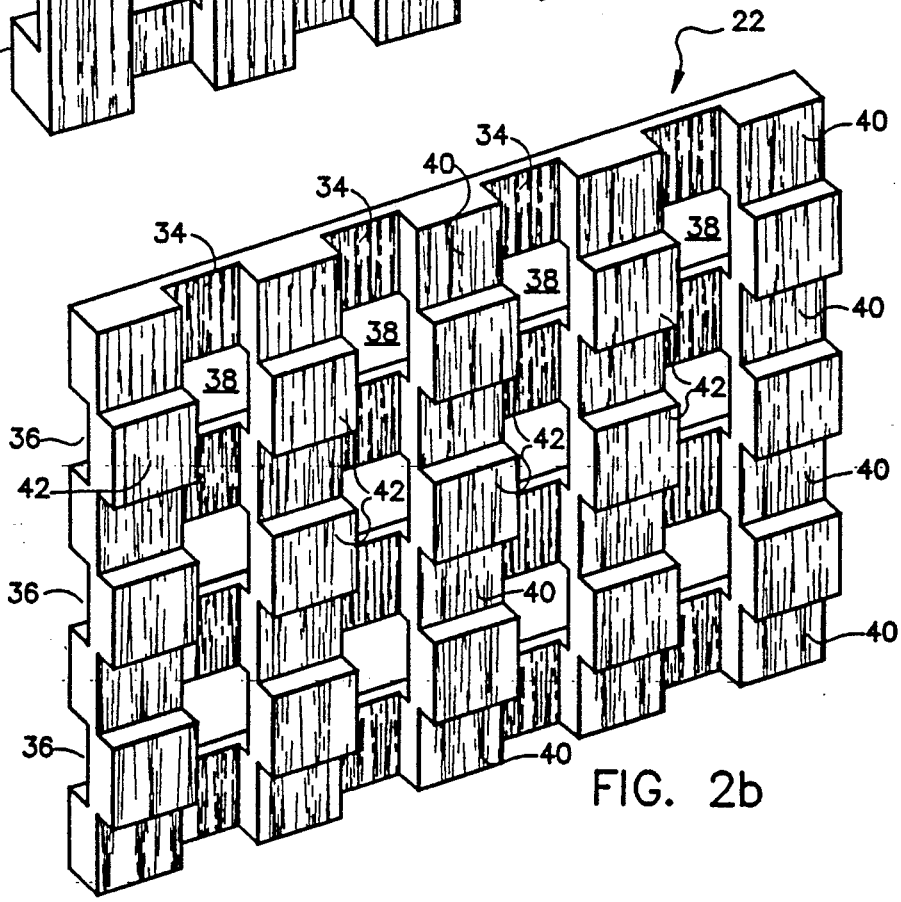

Referring now to the drawing, particularly to FIGS. 1 and 2, there is illustrated a shutter assembly constructed in accordance with a preferred embodiment of the invention. The shutter assembly, designated by the numeral 10, comprises a peripheral frame of a generally rectangular configuration for fitting a door or window opening or the like, and for attachment by hinges at one side to a window or door frame. The frame comprises a pair of vertical members 12 and 14 secured together at the top by horizontal frame members 16 and 18. These are secured together in a conventional fashion, such as by tongue and groove or similar joints for providing a sturdy and rigid construction. Mounted within this frame is a first or stationary panel, designated generally by the numeral 20, and further illustrated in FIG. 2*b*. Mounted directly behind the stationary panel for horizontal sliding movement is a movable panel, designated generally by the numeral 22, and further illustrated in FIG. 2*a*.

The stationary panel 20 is preferably constructed of a unitary panel and is formed as illustrated by a plurality of vertical slots 24, forming vertical bars or rails 26. These may be formed by milling or the like as will be further explained. A plurality of horizontal slots 28 form a similar plurality of horizontally extending bars or rails 30. These cross slots 24 and 28 intersect, forming a plurality of openings or windows 32. These openings or windows may be square or rectangular, but will have a uniform size and configuration as determined by the slots and the spacing thereof.

Referring now to FIG. 2*b*, the sliding panel 22 is formed by a similar unitary panel of slightly less width than that of the stationary panel. In a preferred form, the width of the movable panel may preferably be about two rail or slot widths less than that of the stationary panel. This provides the ability to close the openings 32 from either side of the stationary panel, and more precisely control direct and indirect lighting into and through the panel. The movable panel 22 is formed by means of a plurality of vertical slots 34, which are intersected by a plurality of horizontal slots 36, forming a plurality of openings 38. In addition, a plurality of horizontal slots 40 are formed on the front face of the movable panel, thereby forming a plurality of blocks or faces 42 which are complementary to the slots 28 of the fixed panel. These extend into and are movable into position to block the openings 32 in the fixed panel. Similarly, they move to positions behind the vertical rails or bars 26 of the fixed panel to align the openings 38 in the movable panel, with those 32 in the fixed panel to provide an opening in the shutter assembly.

While these panels are preferably formed of a unitary panel or wood milled into the above described configuration by the cross cutting of grooves, they can be constructed by other means and from other materials. For example, they may be formed by injection molding of plastic panels. The panels need only have sufficient thickness to provide sufficient strength and rigidity for the panel support.

The panels may also actually be constructed of strips of wood or the like of uniform width and spacings secured together in the appropriate configuration. While the strips or rails and slots are described as being of substantially the same width, they are in actuality sufficiently different that the appropriate cooperative interrelationship is achieved. The bars or rails, for example, must be of a slightly less width than the slots to be slideable therein and to enable the panels to move freely relative to one another.

Referring to FIG. 3, there is illustrated a cross sectional view of the panel of FIG. 1 showing a preferred construction of a portion thereof. As can be seen in FIG. 3, the fixed panel 20 is mounted by a tongue and groove construction comprising a tongue 44 extending into a groove 46 in the frame member 18. As in usual door construction, the mounting of the fixed panel is such that certain clearances are permitted to permit relative expansion and contraction between the outer frame and the inner panel.

The movable panel 22 is mounted in the peripheral frame by means of a roller assembly comprising a spherical ball or bearing member 48 at each corner of the panel. The ball bearing member is disposed in complementary semi-cylindrical grooves 50 and 52 formed in the frame member 18 and in the corners of the movable panel 22, as seen in FIG. 4. The grooves 50 in the frame member 18 may extend the full width of the panel. However, the groove 52 in the corners of the movable panel 22 must be sufficient to accommodate the necessary movement thereof, yet retain the roller or ball bearing 48 in position at the corner of the panel. The ball may be held in the channel by means of a tab 53 held in place by a screw or the like (not shown).

The sliding panel may be actuated directly by means of a tab 54, as shown in FIG. 1, which is connected directly to the slideable panel and extending into and through a slot 56 in the front of the stationary panel 20.

An alternate form of actuator, which includes linkage means for applying a force to the upper and lower ends of the slideable panel for panels of substantial height, is illustrated for example in FIG. 5 wherein a surface portion of frame member 14' is broken away to reveal details. As illustrated in FIG. 5, a slide assembly is mounted in the frame member 14', and includes a slide member 58 slideably mounted within the groove 60 formed in frame member 14', and connected by a pair of actuator linkages 62 and 64 directly to the panel 22. The slide 58 includes an upwardly extending finger tab or knob 66 extending upward through a slot in the face of the frame member 14' like tab 54 in slot 56 as illustrated in FIG. 1.

In mounting the actuator assembly, the frame member 14' is either split or formed of two boards or planks of one-half thickness. The back board is provided with a groove or slot 60 to receive the slide 58. The front board is provided with a through slot, (not shown) like slot 56 illustrated in FIG. 1 for tab 66 and any other grooves or the like to accommodate the link members 62 and 64. The front and back boards are then glued together to form the frame member 14'.

The linkage members 62 may be preferably of the type shown in FIG. 6, which comprises an outer tube 70 which is curved in a ninety degree configuration to accommodate different directions of motion. The linkage includes connector tips 72 and 74, each of which are attached to the end of a telescoping tube 76 and 78, each of which extends into the tube 70 and is connected together by a cable. One tip 74 is connected to the inside face of the panel 22 by a nail or screw through a hole therein as shown and the other tip 72 is similarly connected to the actuator on the opposite end. With this arrangement, movement of one tip 72 transmits the force through the cable and tube members to the other tip 74. This arrangement permits a single actuator mounted within the frame to apply uniform lateral forces on the upper and lower ends of the movable frame to move it within the support frame and relative to the stationary frame.

Referring to FIG. 7, a portion of an alternate embodiment is illustrated wherein one or more of the slots have a greater height than width. A stationary front panel 82 is provided with vertical grooves 84 and cross slots 86 and 88 which are of different heights. These may be either the same or different heights. A sliding panel (not shown) is provided with complementary sized cross rails to fit the cross slots. These provide openings 90 and 92 as in the prior embodiment. This illustrates that the combination of different size slots may be incorporated into a single panel. In addition, it further illustrates that the slots may be elongated vertically with a much narrower width as in the previous embodiment.

Referring to FIG. 7 of the drawing, a still further embodiment is illustrated wherein a stationary panel 90 is provided with typical horizontal slots 92. The panel is provided with angled vertical slots 94 so that the bars 96 on the front of the fixed panel are angles relative to the vertical. The slideable panel will similarly have horizontal slots and bars corresponding to the horizontal slots 92 and bars of the back of the front or stationary panel. Similarly, however, the movable panel will have angled slots and bars corresponding to the angled slots 94 and bars 96 on the front of the fixed panel to correlate and correspond the relative openings therein.

While I have illustrated and described my invention by means of specific embodiments, it is to be understood that numerous changes and modifications may be made therein without departing from the spirit and scope of the invention as defined in the appended claims.

I claim:

1. A shutter closure for an opening in a building comprising:

a stationary panel defined by a plurality of cross rails forming a substantially uniform array of openings throughout a major area thereof;

a movable panel formed of a complementary plurality of cross rails forming a corresponding array of openings and movable relative to said first panel for alternately covering and uncovering said openings in said first panel; and said stationary panel and said movable panel are each made from a unitary structure, and said rails are defined by spaced vertical slots on a front face and horizontal slots on a back face, said vertical slots are at an angle other than ninety degrees to the horizontal, and said openings are defined by intersection of said vertical slots with said horizontal slots.

2. A shutter closure according to claim 1 wherein:

said movable panel has a front face and a back face and a plurality of horizontally arranged blocks extending forwardly into said horizontally extending slots in the back face of said stationary panel and selectively movable to positions for blocking said openings.

3. A shutter closure according to claim 1 wherein:

said rails and said slots are of substantially identical width.

4. A shutter closure according to claim 1 wherein:

said stationary panel is secured in a peripheral frame; and said movable panel is movably supported in said frame by roller means at each corner thereof comprising a rigid sphere confined within opposed semi-spherical slots within said frame and said movable panel.

5. A shutter closure according to claim 4 wherein:

said movable panel is controlled by actuator means comprising a slide mounted in said frame and flexible connectors connecting said slide to spaced upper and lower portions of said panel for simultaneously applying a force thereto.

6. A shutter closure according to claim 4 wherein:

said movable panel has a front face and a back face and a plurality of horizontally arranged blocks extending forwardly into said horizontally extending slots in the back face of said stationary panel and selectively movable to positions for blocking said openings.

* * * * *